US009339679B2

(12) United States Patent
Ertl

(10) Patent No.: US 9,339,679 B2
(45) Date of Patent: May 17, 2016

(54) ACCESSORIES FOR CLASSROOM FURNITURE

(71) Applicant: Scott Neil Ertl, Winston-Salem, NC (US)

(72) Inventor: Scott Neil Ertl, Winston-Salem, NC (US)

( * ) Notice: Subject to any disclaimer, the term of this patent is extended or adjusted under 35 U.S.C. 154(b) by 0 days.

(21) Appl. No.: 14/465,353

(22) Filed: Aug. 21, 2014

(65) Prior Publication Data

US 2015/0328493 A1 Nov. 19, 2015

Related U.S. Application Data

(60) Provisional application No. 61/993,737, filed on May 15, 2014.

(51) Int. Cl.

| | |
|---|---|
| ***A47C 7/52*** | (2006.01) |
| ***A63B 21/04*** | (2006.01) |
| ***A47C 7/62*** | (2006.01) |
| ***A47B 13/00*** | (2006.01) |
| ***A47B 41/00*** | (2006.01) |
| ***A47B 95/00*** | (2006.01) |
| ***A63B 21/055*** | (2006.01) |
| ***A63B 23/04*** | (2006.01) |

(52) U.S. Cl.

CPC ..... *A63B 21/0414* (2013.01); *A47B 13/00* (2013.01); *A47B 41/00* (2013.01); *A47B 95/00* (2013.01); *A47C 7/52* (2013.01); *A47C 7/62* (2013.01); *A63B 21/0552* (2013.01); *A63B 23/04* (2013.01)

(58) Field of Classification Search

CPC ..... A47C 16/02; A47C 16/025; A47C 7/62; A47C 7/52; A63B 21/0414; A63B 21/0552; A63B 23/04; A47B 13/00; A47B 41/00; A47B 95/00

See application file for complete search history.

(56) References Cited

U.S. PATENT DOCUMENTS

| | | | | |
|---|---|---|---|---|
| 5,207,481 | A * | 5/1993 | Ayala, Jr. | A47D 15/006 297/423.4 |
| 5,826,941 | A * | 10/1998 | Olsen | A47C 16/02 108/108 |
| 6,117,056 | A * | 9/2000 | Cataldi, Jr. | A63B 21/0552 482/121 |
| 8,061,278 | B2 | 11/2011 | Skiba | |
| 8,246,118 | B2 * | 8/2012 | Moore | A47C 7/506 297/423.1 |
| 8,291,833 | B2 | 10/2012 | Skiba | |

(Continued)

FOREIGN PATENT DOCUMENTS

| | | |
|---|---|---|
| CN | 203194985 | 9/2013 |

OTHER PUBLICATIONS

Patent Cooperation Treaty, International Search Report and Written Opinion, International Application No. PCT/US2015/030477, dated Aug. 10, 2015.

*Primary Examiner* — Philip Gabler

(74) *Attorney, Agent, or Firm* — Kilpatrick Townsend & Stockton LLP

(57) ABSTRACT

The present invention relates generally to accessories for classroom furniture items. In some embodiments, an accessory for a classroom furniture item having at least two legs comprise at least two supports wherein each support is configured to surround at least a portion of a leg of an item of classroom furniture, and an elastic cord comprising two ends, wherein a first end is configured to be coupled to a first leg of the item above a first support and wherein a second end is configured to be coupled to a second leg of the item above a second support. Some embodiments of the present invention also relate to portable leg movement accessories.

19 Claims, 7 Drawing Sheets

(56) References Cited

U.S. PATENT DOCUMENTS

| | | | | |
|---|---|---|---|---|
| 8,434,824 | B2 * | 5/2013 | Spinabella | A47B 97/00 108/50.14 |
| 2004/0094668 | A1 | 5/2004 | Jarosz | |
| 2005/0113223 | A1 | 5/2005 | Dovner et al. | |
| 2006/0082206 | A1 | 4/2006 | Travis | |
| 2014/0008943 | A1 | 1/2014 | Benden | |

* cited by examiner

ACCESSORIES FOR CLASSROOM FURNITURE

CROSS-REFERENCE TO RELATED APPLICATIONS

This application claims priority to U.S. Provisional Patent Application Ser. No. 61/993,737, filed on May 15, 2014, which is hereby incorporated by reference as though fully set forth herein.

FIELD OF THE INVENTION

The present invention relates generally to accessories for classroom furniture that can be used, for example, on desks, tables, chairs, and other classroom furniture.

BACKGROUND OF THE INVENTION

Teachers often require students to sit at their desks for extended periods of time. However, students need to move throughout the day and often feel frustrated when they are trapped at their desk for hours at a time and expected to "sit still, be quiet, and complete their work." Students with attention deficit hyperactivity disorder (ADHD) sometimes get in trouble at school because they need ways to channel their hyperactive energy, but do not know what to do other than lean back in their chairs, fiddle with items in their desks, move around the room, etc. Similarly, students with learning disabilities sometimes get frustrated easily when working, especially when reading and writing. Their increased anxiety and frustration can quickly escalate to low performance and high discipline problems. Students with shorter legs (e.g., students whose feet may not reach the floor when sitting at their desks) may not like their feet dangling or may get in trouble for sitting on their feet in their chair. Students with Restless Leg Syndrome (RLS) need a way to move without distracting others. Much research show how students with Asperger's Syndrome, autism, social anxiety disorder, and other conditions benefit strongly from having sensory relief from motor stimulation. Many occupational therapists have used different resources for providing such relief.

It would be desirable to develop a way to make school a more pleasant experience for students who have high energy, high anxiety, or short legs, or who otherwise have difficulty sitting still for extended periods of time.

SUMMARY

Various embodiments of the present invention provide accessories for classroom furniture, items of classroom furniture utilizing such accessories, and related items. Such classroom furniture can include, in some embodiments, desks, chairs, tables, and other furniture typically used in classrooms and other learning environments. The accessories can provide a number of advantages that are discussed in more detail herein.

In some embodiments, an accessory for a classroom furniture item having at least two legs comprises at least two supports wherein each support is configured to surround at least a portion of a leg of an item of classroom furniture, and an elastic cord comprising two ends, wherein a first end is configured to be coupled to a first leg of the item above a first support and wherein a second end is configured to be coupled to a second leg of the item above a second support. Each support can comprise a hollow tube in some embodiments.

In some embodiments, an accessory for a classroom furniture item having at least two legs comprises at least two hollow tubes wherein each tube has a length of at least six inches and wherein each tube is configured to surround at least a portion of a leg of an item of classroom furniture, and an elastic cord comprising two ends, wherein a first end is configured to be coupled to a first leg of the item above a first hollow tube and wherein a second end is configured to be coupled to a second leg of the item above a second hollow tube.

In some embodiments an accessory for a classroom furniture item having at least two legs comprises at least two circular hollow tubes wherein each tube has a length of at least six inches, wherein each tube has a diameter of at least 1.25 inches, and wherein each tube is configured to surround at least a portion of a leg of an item of classroom furniture, and an elastic cord comprising two ends, wherein a first end comprises a first loop configured to slide over a first leg of the item and wherein a second end comprises a second loop configured to slide over a second leg of the item.

In some embodiments, the hollow tubes can comprise at least one hinge. In some embodiments, the first end of the elastic cord comprises a first loop configured to slide over the first leg of the item and the second end of the elastic cord comprises a second loop configured to slide over the second leg. A plurality of beads can be positioned on the elastic cord in some embodiments. When installed on a desk, in some embodiments, a first support is positioned on a first leg of the desk, a second support is positioned on a second leg of the desk, the first end of the cord is coupled to the first leg above the first support, and the second end of the cord is coupled to the second leg above the second support, and wherein the supports prevent the elastic cord from sliding down the first and second legs of the desk. When installed on a chair, in some embodiments, a first support is positioned on a first leg of the chair, a second support is positioned on a second leg of the chair, the first end of the cord is coupled to the first leg above the first support, and the second end of the cord is coupled to the second leg above the second support, and wherein the supports prevent the elastic cord from sliding down the first and second legs of the chair.

Some embodiments of the present invention relate to a portable accessory that can provide similar benefits to the accessories for classroom furniture items described herein without being positioned on a piece of furniture. In some embodiments, a portable leg movement accessory comprises a stand wherein the stand comprises two side structures connected by a horizontal structure, and an elastic cord comprising two ends, wherein a first end is configured to be coupled to a first side structure and wherein a second end is configured to be coupled to a second side structure. Each side structure, in some embodiments, can comprise a notch, hole or similar structure to receive an end of the elastic cord. In some embodiments, each end of the elastic cord can comprise a knot, knob, disk, ferrule, or similar structure to hold the ends in the corresponding notches, holes, grooves or other structure in the side structures to receive and secure the ends of the elastic cord.

These and other embodiments of the present invention are described in greater detail in the Detailed Description that follows.

DETAILED DESCRIPTION

Figure 1:
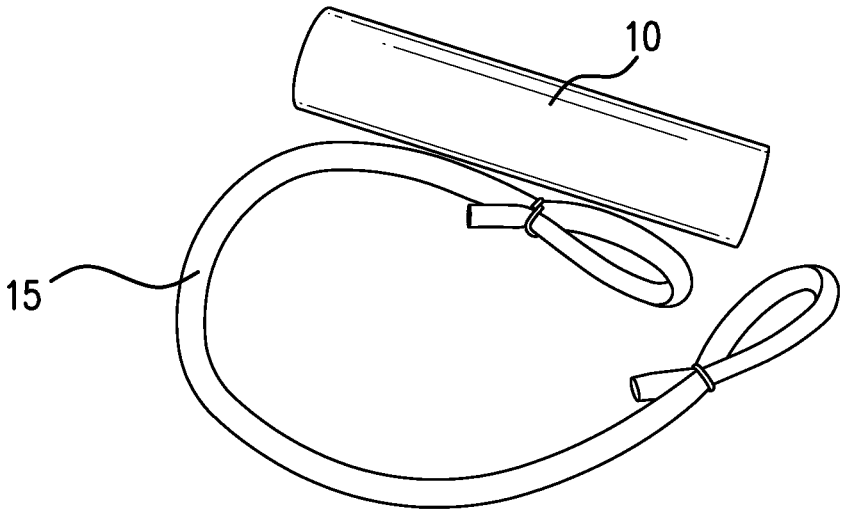
FIG. 1 is an accessory for a classroom furniture item having at least two legs according to one embodiment of the present invention.

The following description recites various aspects and embodiments of the present invention. No particular embodiment is intended to define the scope of the invention. Rather, the embodiments merely provide non-limiting examples of various methods and systems that are at least included within the scope of the invention. The description is to be read from the perspective of one of ordinary skill in the art; therefore, information well known to the skilled artisan is not necessarily included.

As used herein, "a," "an," and "the" include plural referents, unless expressly and unequivocally disclaimed.

The present invention relates generally to accessories for use with classroom furniture items. Such classroom furniture items have at least two legs (typically, two to four legs). While embodiments of the present invention are generally described in connection with their usage with desks, it should be understood that such accessories can likewise be used or adapted for use with tables, chairs, and other furniture items typically used in classrooms and other learning environments.

Embodiments of classroom furniture accessories of the present invention can provide a number of advantages. For example, in some embodiments, the accessories can provide a way for students to stretch their legs and bounce while they think (e.g., help the students relax so they can focus/think more). As another example, classroom furniture accessories, in various embodiments, can allow students to move while making minimal noise, without distracting other students, and/or without interfering with a teacher's instruction. Some embodiments of classroom furniture accessories of the present invention can provide comfort to some students whose feet may not be able to reach the floor but may be able to rest them on the furniture accessory. In general, embodiments of classroom furniture accessories of the present invention can assist a variety of students having different needs by providing a level of stimulation to the students in an acceptable way without distracting other students or their teacher.

In some embodiments, a classroom furniture accessory comprises two supports and an elastic cord comprising two ends, wherein each support is configured to surround at least a portion of a leg of the furniture and wherein each end of the elastic cord is configured to be coupled to a leg of the furniture above the support on that leg.

In some embodiments, an accessory for a classroom furniture item having at least two legs comprises at least two supports wherein each support is configured to surround at least a portion of a leg of an item of classroom furniture, and an elastic cord comprising two ends, wherein a first end is configured to be coupled to a first leg of the item above a first support and wherein a second end is configured to be coupled to a second leg of the item above a second support. Each support can comprise a hollow tube or similar hollow structure in some embodiments.

In some embodiments, an accessory for a classroom furniture item having at least two legs comprises at least two hollow tubes wherein each tube has a length of at least six inches and wherein each tube is configured to surround at least a portion of a leg of an item of classroom furniture, and an elastic cord comprising two ends, wherein a first end is configured to be coupled to a first leg of the item above a first hollow tube and wherein a second end is configured to be coupled to a second leg of the item above a second hollow tube.

In some embodiments, an accessory for a classroom furniture item having at least two legs comprises at least two circular hollow tubes wherein each tube has a length of at least six inches, wherein each tube has a diameter of at least 1.25 inches, and wherein each tube is configured to surround at least a portion of a leg of an item of classroom furniture, and an elastic cord comprising two ends, wherein a first end comprises a first loop configured to slide over a first leg of the item and wherein a second end comprises a second loop configured to slide over a second leg of the item.

As indicated above, in some embodiments, each support comprises a hollow tube or other hollow structure. In such embodiments, the hollow tube or similar structure can slide over the leg to surround at least a portion of the leg. While the support may be referred to herein as a "hollow tube," it should be understood that the term "tube" is not intended to limit the support to structures having only round cross-sections and that the term "tube" should be understood to include supports with square, rectangular, triangular, oval, hexagonal, octagonal, pentagonal, or other cross-sections.

Some furniture styles may have a crossbar, a lengthy base, or other structure that make it difficult or impossible to position a hollow tube onto the leg of the furniture. To accommodate such situations, in some embodiments, the support can comprise at least one hinge or similar structure, as discussed in more detail below, to permit the support to open enough to fit around the leg.

As indicated above, each end of the elastic cord can be coupled to a leg of the furniture item above the support on that leg. In other words, the support can help maintain the elastic cord at a desired height on the leg by preventing it from sliding down the leg. As discussed below, the elastic cord can be constructed from a variety of elastic materials. In some embodiments, each end of the elastic cord comprises a loop configured to slide over the leg of the furniture item. In some embodiments, the elastic cord can be coupled to the legs of the furniture item by securing each end of the elastic cord to a leg of the furniture item with a fastener. An end of the elastic cord, in some embodiments, can be secured to the leg of the furniture item by tying the end to the leg.

Referring now to the Figures, FIG. 1 illustrates the components of one embodiment of an accessory for a classroom furniture item of the present invention. FIG. 1 shows an example of a support 10 and an elastic cord 15. As shown in FIGS. 2-5, such an embodiment of an accessory 5 for a classroom furniture item can comprise two such supports 10 with the elastic cord 15.

As shown in the Figures, the supports 10 are designed to permit desk legs 20 to slide inside such that each support 10 surrounds at least a portion of the leg 20. In the embodiments shown, the supports 10 are hollow cylinders. As noted above, in other embodiments, the supports can be hollow tubes having other cross-sections such as square, rectangular, triangular, oval, hexagonal, octagonal, pentagonal, or others. The supports can be constructed from a number of materials including, without limitation, pipe formed from PVC or other plastics, bamboo, and other materials. In selecting a material to use for the support, one should consider whether the material will provide enough rigidity to withstand the stretching/relaxing of the elastic cord when a user exercises their legs using the elastic cord. In other words, the material used for the support, in some embodiments, should be rigid enough to maintain the elastic cord at a desired height above the floor so that a person sitting on or near the furniture can reach the elastic cord with his or her feet. As to the height or length of the supports, persons of ordinary skill in the art can select an appropriate height depending on any number of factors including, without limitation, the size of the furniture, the height of the furniture, the typical size of the user of the furniture, the furniture to which the accessory is to be attached, the elasticity of the elastic cord, and other factors. For example, for a desk or chair in an elementary school classroom, the supports, in some embodiments, can be less than 12 inches long. In some embodiments for use with desks and chairs in elementary school classrooms, the supports can have a length of about eight inches. The supports, in some embodiments, can have a length of at least six inches.

The diameter of the supports (or width depending on the cross-sectional shape) can be a variety of sizes depending, for example, on the size of the legs of the classroom furniture items upon which the supports will be placed. In some embodiments, the diameter of the supports is greater than about 1.25 inches. The diameter of the supports in some embodiments is less than 5 inches. In some embodiments, the diameter of the supports is between about 1.25 inches and about 5 inches. The diameter of the supports is between about 1.25 inches and about 4 inches in some embodiments. In some embodiments, the diameter of the supports is between about 1.25 and about 2 inches. The diameter of the supports is about 1.5 inches in some embodiments. In some embodiments, the diameter of the supports is between about 1.5 inches and about 4 inches.

Depending on the material used to construct the supports and how the supports are constructed, in some embodiments, the edges of the supports may be rounded or otherwise tapered to eliminate sharp edges. The rounding or tapering of these edges can prevent friction or abrasion when the elastic cord is positioned against the edges during use. For example, sharp edges could cause significant wear or tears on the elastic cord over time. In some embodiments, the inside edges of the supports can also be rounded or otherwise tapered. For example, the rounding or tapering of the inside edges can help prevent injuries that might occur if a student were to insert his or her fingers or toes inside the support.

Supports can be formed using techniques known to those of skill in the art. In some embodiments, supports can be formed by cutting ten to twenty foot long PVC pipes into eight inch pieces using a miter saw with an extra fine tooth blade. The edges can be rounded or tapered using routing, sanding, grinding, or other techniques known to those of skill in the art.

Figure 2:
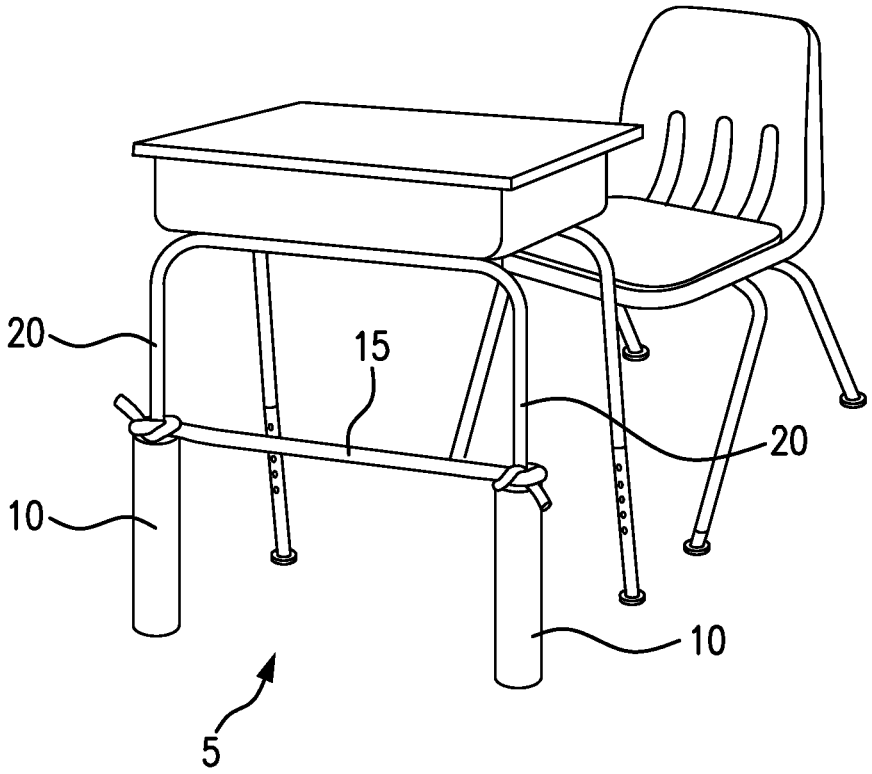
FIG. 2 is an accessory for a classroom furniture item according to one embodiment of the present invention installed on a desk.
Figure 3:
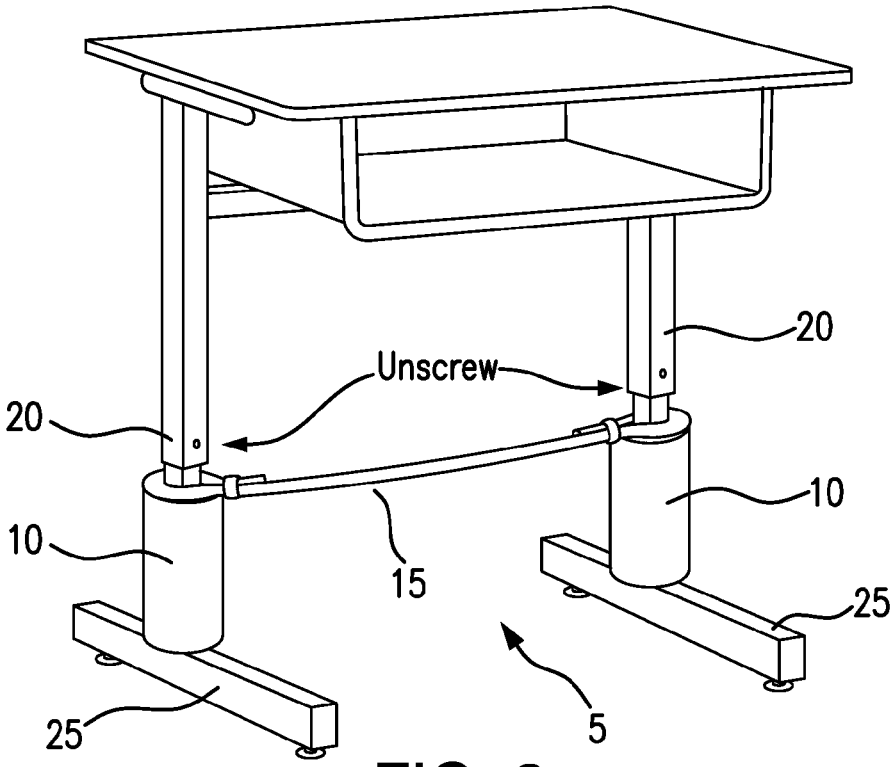
FIG. 3 is an accessory for a classroom furniture item according to one embodiment of the present invention installed on a desk where the legs of the desk need to be unscrewed to install the accessory.
Figure 4:
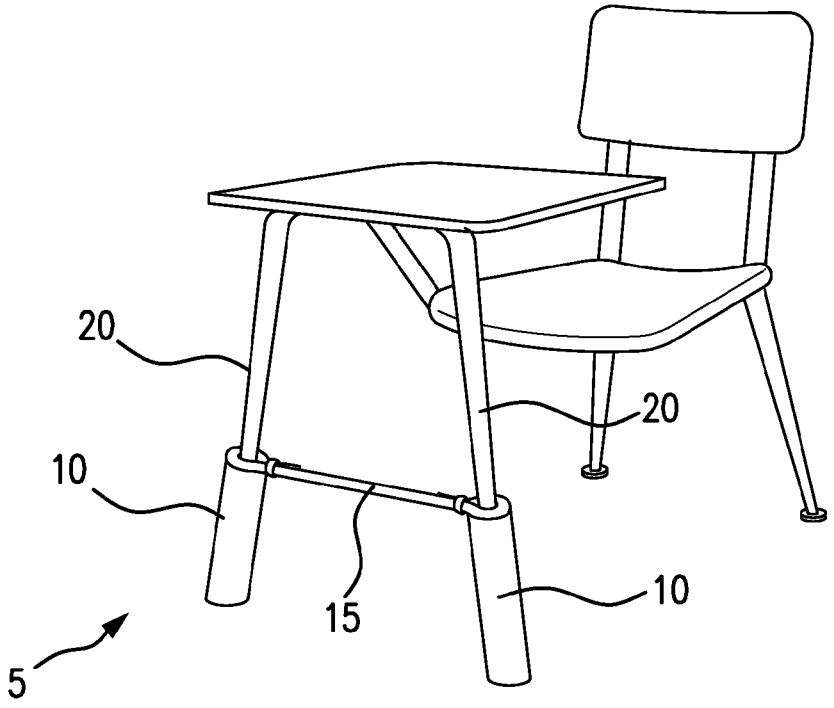
FIG. 4 is an accessory for a classroom furniture item according to one embodiment of the present invention installed on a desk that is attached to a chair.
Figure 5:
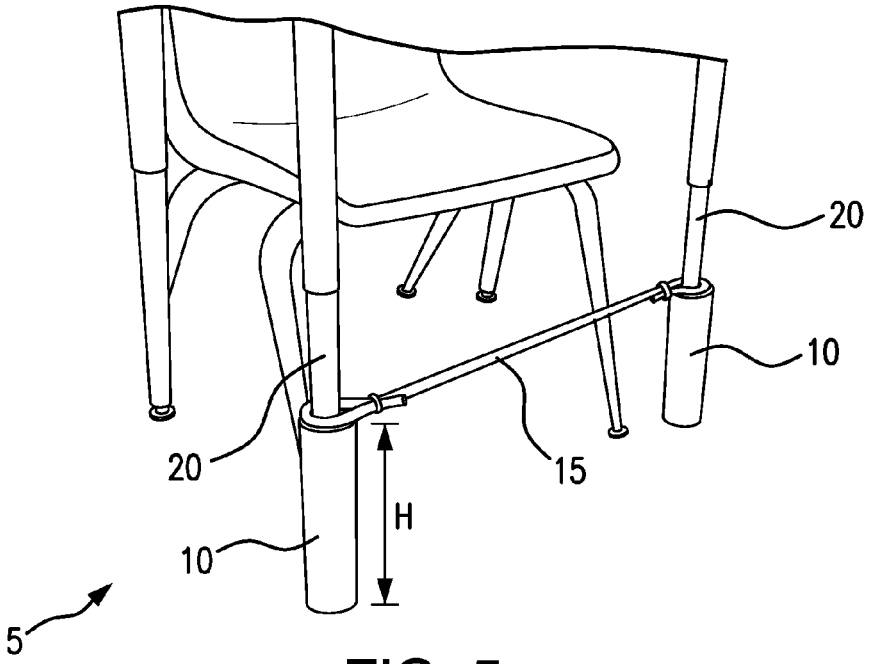
FIG. 5 is an accessory for a classroom furniture item according to one embodiment of the present invention installed on a desk.

As shown in the various Figures, the supports 10 can accommodate a variety of desk styles. For example, FIG. 3 shows the supports 10 on a desk where the desk has lower legs 25 that screw into upper legs 20. To install the supports 10, the lower legs 25 can be unscrewed from the upper legs 20 to permit the supports 10 to be slid over the lower legs 25. In the embodiments shown in FIGS. 2, 4, and 5, the supports 10 slide directly over the legs 20.

Figure 6:
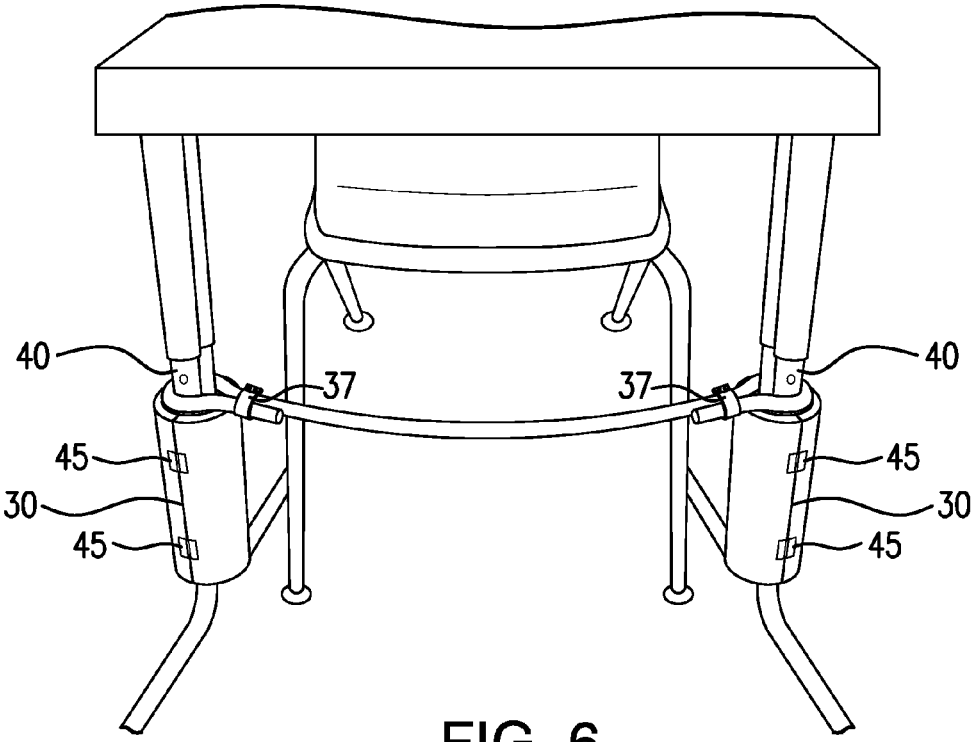
FIG. 6 is an accessory for a classroom furniture item according to one embodiment of the present invention installed on a desk where the legs of the desk are not openly accessible at the bottom.

Some furniture accessories may have a crossbar, a lengthy base, or other structure that make it difficult or impossible to slide a support onto the leg of the furniture. To accommodate such situations, in some embodiments, a support can comprise at least one hinge or similar structure to permit the support to open enough to fit around the leg. An example of such a desk is shown in FIG. 6 where the supports 30 are not able to be installed by sliding them over the legs 40. In this embodiment, each support 30 is provided with two hinges 45 to permit the supports 30 to open and fit around the legs 40. In some such embodiments, any hinge known to those of skill in the art can be used. Various factors can be important in selecting the hinge including the material from which the support is constructed, the length of the support, the width or diameter of the support, the thickness of the support, and others. Persons of ordinary skill in the art can identify other ways to permit the supports to open to fit around legs of furniture accessories in other embodiments. For example, in some embodiments, only one hinge or two hinges may be used per support, while in other embodiments three or more hinges can be used. In some embodiments, a support may be constructed from a material that is flexible to permit the support to open wide enough to fit around a furniture leg simply by cutting along the length of the support (the support may be resilient enough to open to fit around the leg and then close back when released). In some embodiments, hook-and-loop type fasteners (e.g., Velcro), or other fasteners may be used to facilitate opening and closing the supports for installation on furniture legs. In some embodiments, a promotional label or a piece of tape may be used to facilitate opening and closing the supports for installation on furniture legs.

Figure 7:
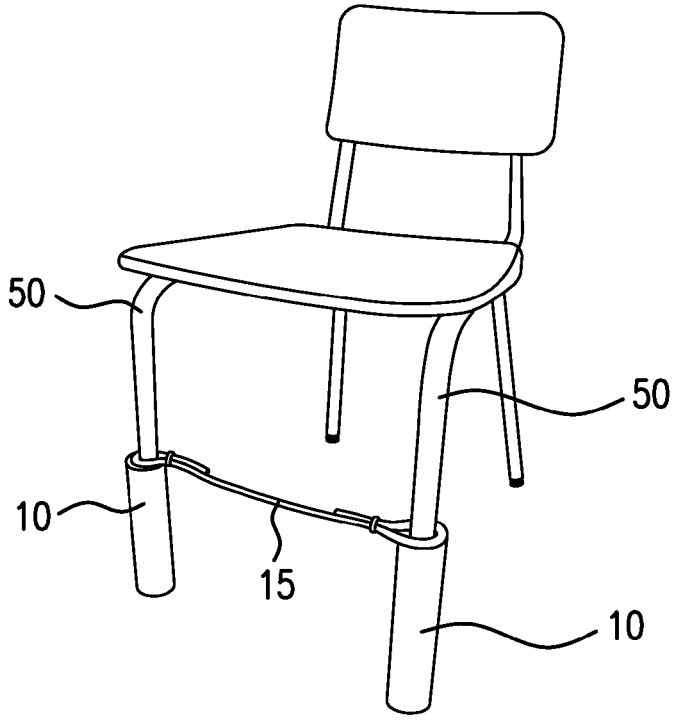
FIG. 7 is an accessory for a classroom furniture item according to one embodiment of the present invention installed on a chair.
Figure 8:
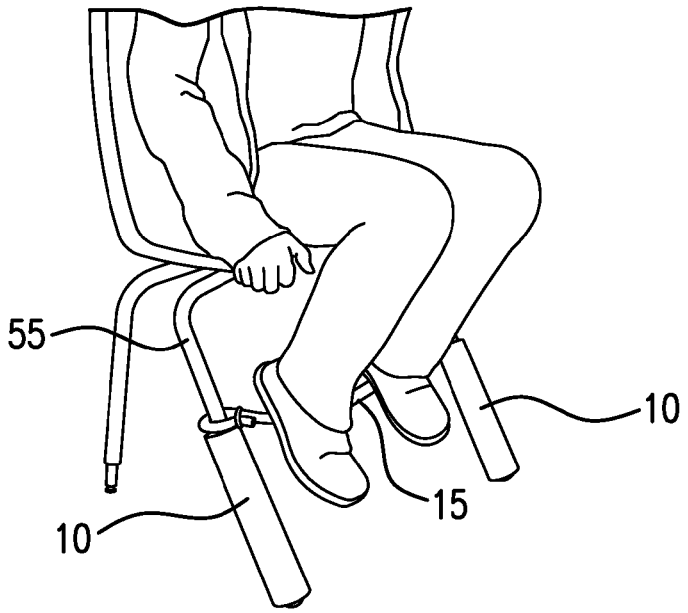
FIG. 8 is an accessory for a classroom furniture item according to one embodiment of the present invention installed on a chair being used by a student.

In addition to desks, classroom furniture accessories of the present invention can also be used on other types of furniture items. For example, FIGS. 7 and 8 show certain embodiments of classroom furniture accessories installed on chairs. In these embodiments, the supports 10 can slide over the chair legs 50,55 with the elastic cord 15 positioned on the supports 10. The classroom furniture accessories can be used in the same manner as when used on desks. As previously indicated, various embodiments of the present invention can also be installed on other types of furniture items such as tables, desk/chair combinations (see, for example, FIG. 4), etc.

As discussed above, each end of the elastic cord 15 can be coupled to a leg 20 of the furniture above the support 10 on that leg 20. In other words, the supports 10 can help maintain the elastic cord 15 at a desired height above the floor (see, for example, "H" in FIG. 5) by preventing it from sliding down the leg 20. The elastic cord can be constructed from a variety of elastic materials. In some embodiments, the elastic cord 15 can be constructed from rubber rope (similar to bungee cord). One non-limiting example of a rubber rope that can be used to form an elastic cord in some embodiments is a solid core rubber rope having a diameter of 7/16 of an inch and which is commercially available from a number of sources (e.g., item no. RR438X from Pacific Cargo Corporation). In other embodiments, the elastic cord 15 can be constructed from an inner tube for a bicycle tire, from a multi-strand bungee cord, or from similar materials. A number of factors can be important in selecting the material for the elastic cord 15. In various embodiments, the material should have enough resistance to require some effort for the person to extend it, should have enough elasticity to return to its nominal unstretched length when not in use, should be durable enough to withstand repetitive usage, should be somewhat resistant to tearing (e.g., due to contact with the user's shoes, repetitive contact with the supports, etc.), etc. Another factor in selecting an elastic cord for use in some embodiments is color; it may be desirable to use an elastic cord having a particular color or a variety of colors.

The length of the elastic cord 15 can vary depending on the furniture item on which the accessory is to be installed. In general, the elastic cord should have a length to extend between the two legs upon which the supports are installed with minimal, if any, stretching of the elastic cord. For example, if the elastic cord is too long, it may not provide adequate resistance to the person at a desk seeking to use the accessory. If the elastic cord is too short, it may put constant tension on the two legs (pull them toward one another) which could cause damage to the furniture.

The elastic cord 15 can be coupled to the furniture legs 20 in a number of ways. In FIGS. 1, 3-8, each end of the elastic cord 15 (35) comprises a loop configured to slide over the leg 20,40,50 of the furniture. In FIG. 6, the loops at each end of the elastic cord 35 are formed using clamps 37. In such embodiments, the loops can optionally be formed around the legs as compared to embodiments where the loops are formed first and then slid over the furniture legs. In FIG. 2, each end of the elastic cord 15 is coupled to the legs 20 of the furniture by securing each end of the elastic cord to a leg. Elastic cords can be coupled to furniture legs in other ways known to those of skill in the art.

In some embodiments, a plurality of beads or similar items can be threaded on the elastic cord. The beads can be rounded and smooth in some embodiments. The beads can comprise a hole to permit them to slide onto the elastic cord during manufacture or assembly of the elastic cord in some embodiments. In some embodiments, the beads can be of a size and shape such that the beads comfort and/or massage the student or user's feet. Beads can be made from wood, plastic, rubber, foam, and any other materials that provide added relief and/or stimulation to the user. Beads may be round, oval, ribbed, grooved, cubical, pyramidal, or any other shape that provides added relief and/or stimulation. Beads can have a size between about 0.25 inches and three inches. Spacers may be provided on the elastic cord between the beads, in some embodiments, to prevent the beads from touching one another. In some embodiments, the beads are threaded onto the elastic cord without spacers. In embodiments where spacers are used, the spacers may have a length between about 0.5 inches and about two inches to keep the beads separated by at least that distance. In some embodiments, beads having multiple sizes may be threaded on the elastic cord to potentially provide even more relief, pleasure, or stimulation for the user.

Figure 9:
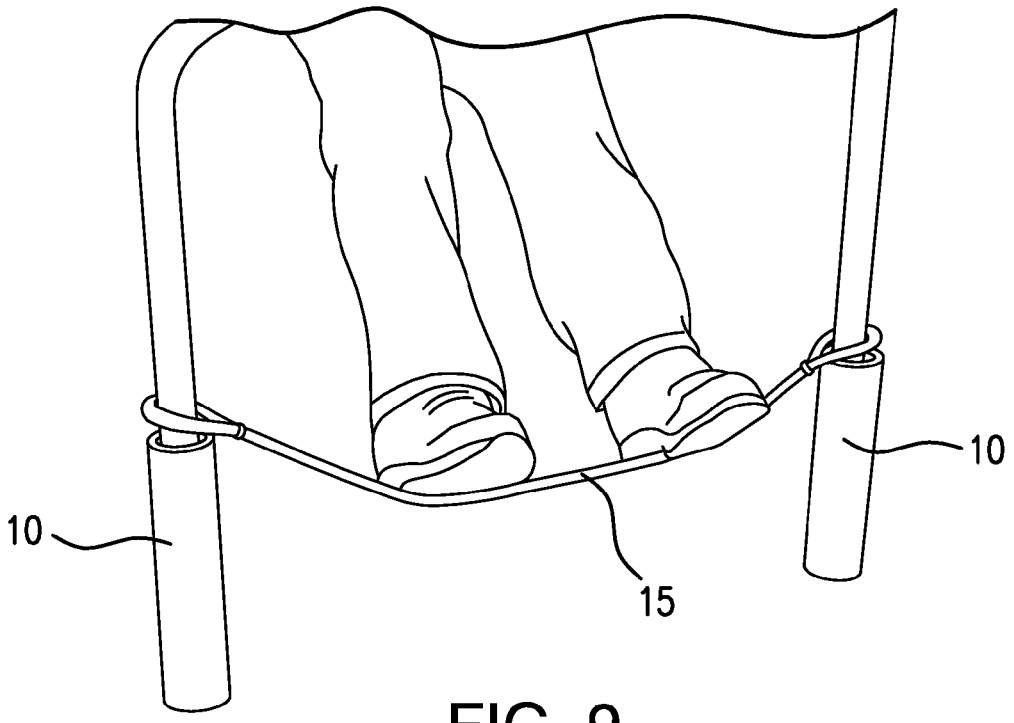
FIG. 9 illustrates potential usage of an accessory for a classroom furniture item according to one embodiment of the present invention installed on a desk.
Figure 10:
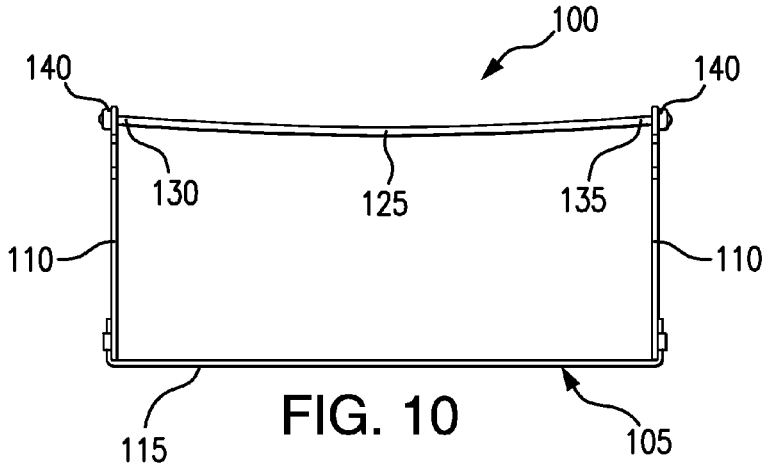
FIG. 10 illustrates a portable leg movement accessory according to one embodiment of the present invention.
Figure 11:
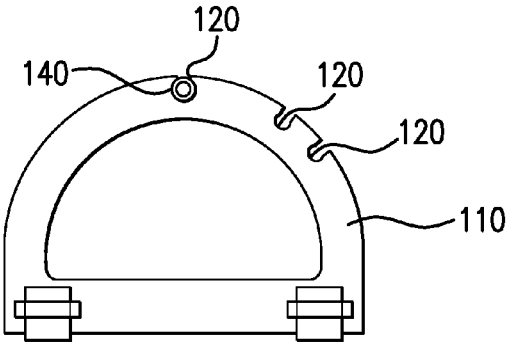
FIG. 11 illustrates a portable leg movement accessory according to one embodiment of the present invention.
Figure 12:
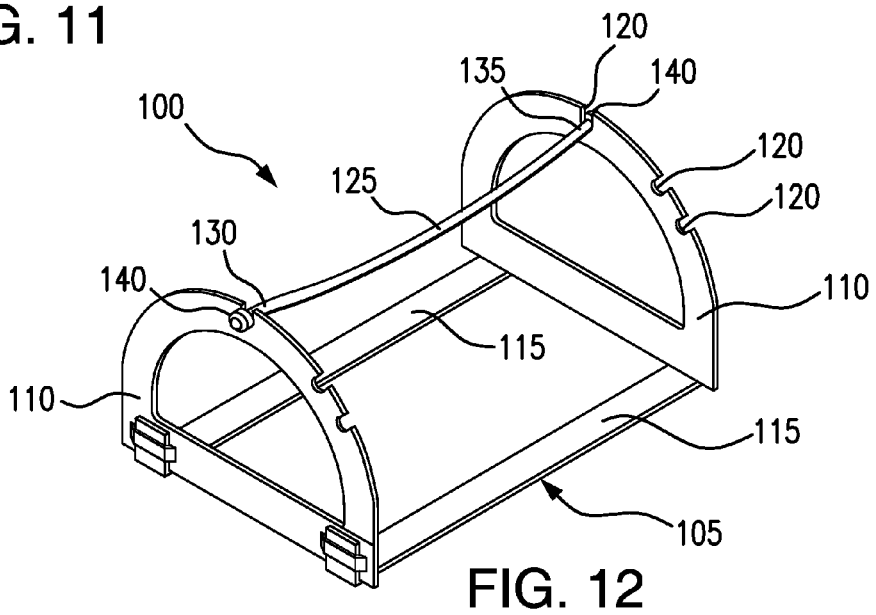
FIG. 12 illustrates a portable leg movement accessory according to one embodiment of the present invention.

FIG. 9 illustrates usage of one embodiment of an accessory for a classroom furniture item of the present invention. As is evident from FIG. 9 and the FIGS. 2-8, classroom furniture accessories of the present invention can be utilized in multiple ways. In some embodiments, the elastic cord and the supports can be attached to the two front legs of a student desk for students to stretch their legs, rest or bounce their feet while they work. In some embodiments, the elastic cord and the supports can be attached to the front two legs of a student's chair for similar results. The supports advantageously prevent the elastic cord from sliding down to the floor. Further, the supports assist in keeping the elastic cord at the optimum height for comfort and use. In some embodiments, the supports can be formed from a white material (e.g., PVC pipe), which can advantageously permit students or other users to decorate and/or personalize the supports using markers, paints, stickers, and similar supplies. Supports can also be manufactured in different colors for students to have options that match their preference. The colors for the support pipes include: red, orange, yellow, green, blue, pink, purple, black, white, and they are not limited to these colors.

Some embodiments of the present invention relate to portable accessories that can provide similar benefits to the accessories for classroom furniture described herein without being positioned on a piece of furniture. Such accessories can permit the same types of movement as the accessories for classroom furniture items described herein without being coupled to a desk, chair, or other classroom furniture item. Such portable accessories are independent of a furniture item and thus can be used in a wide variety of locations including offices, homes, and schools. For example, an adult could position such a portable accessory under his or her desk and move his or her legs while seated at the desk. In general, such portable accessories comprise a stand having two side structures with the elastic cord extending between the two side structures.

In some embodiments, a portable leg movement accessory comprises a stand wherein the stand comprises two side structures connected by a horizontal structure, and an elastic cord comprising two ends, wherein a first end is configured to be coupled to a first side structure and wherein a second end is configured to be coupled to a second side structure. Each side structure, in some embodiments, can comprise a notch, hole, groove or similar structure to receive an end of the elastic cord. Each side structure, in some embodiments, can comprise a plurality of notches, holes, grooves, or similar structures such that the elastic cord can be placed in different locations depending on the height of the chair that a user is sitting in, the length of a user's legs, or other factors. In some embodiments, each end of the elastic cord can comprise a knot, knob, disk, ferrule, or similar structure to hold the ends in the corresponding notches, holes, or other structure in the side structures.

FIGS. 10-14 illustrate one embodiment of a portable leg movement accessory 100 according to the present invention. The portable accessory comprises a stand 105 with two side structures 110. In the embodiment shown, two horizontal structures 115 connect the side structures 110, although in other embodiments, there may only be a single horizontal structure connecting the side structures. In the embodiment shown, the stand 105 is designed in a way that permits it to collapse into a more compact arrangement for transport. For example, the stand can be assembled with grommets for hinging, slots that hold and insert the upright pieces, and tabs to secure positioning, as well as other techniques that will be apparent to those of skill in the art. In some such embodiments, the horizontal structure(s) and side structures are separate components, although it should be understood that a single unitary stand can be formed having one or more horizontal structures and side structures. In some embodiments, the stand does not collapse, fold, or otherwise change configuration. Regardless, the stand can still be portable whether it is designed to collapse into a smaller volume or not. The stand can be constructed from a variety of materials known to those of skill in the art including, for example, aluminum, steel, wood, and plastic.

In the embodiment shown in FIGS. 10-14, the side structures 115 have a generally semi-circular shape and are provided with a plurality of notches 120. The semi-circular shape of the side structures 115 and the plurality of notches 120 facilitate placement of an elastic cord at different locations on the stand (e.g., different heights). However, persons of skill in the art will recognize that side structures having other shapes can also be used. Examples of such shapes include square, rectangular, triangular and others. Where desired, such shapes can also be provided with notches, grooves, or holes to similarly permit positioning of an elastic cord at different locations.

While notches 120 are shown in FIGS. 10-14, other structures can be provided in the side structures 110 to facilitate connection with an elastic cord. For example, in some embodiments, holes can be provided in the side structures.

As with the other accessories for classroom furniture items, an elastic cord 125 extends between the two side structures 110 in the portable accessory shown in FIGS. 10-14. The elastic cord 125 comprises two ends, wherein a first end 130 is configured to be coupled to a first side structure 110 and wherein a second end 135 is configured to be coupled to a second side structure 110. The elastic cord 125 can be coupled to the side structures 110 in a variety of ways. In the embodiment shown, each end 130,135 of the elastic cord 125 is provided with a stop collar 140. When the ends 130, 135 of the elastic cord 125 are positioned in the notches 120, the stop collars 140 hold the elastic cord 125 in the notches 120. The stop collar 140 also facilitates moving the elastic cord 125 to other notches 120 on the side structures 110 to, for example, adjust the height of the elastic cord.

As another example, instead of a stop collar, an item with a shape similar to a rivet can be provided on each end of the elastic cord 125. The rivet-like item can have a top portion with a diameter that is wider than the notch 120 in the side structure 110. A hollow cylindrical portion can extend from the top portion of the rivet-like item and, in some embodiments, can fit within the notch 120 (or groove or hole). In this manner, the hollow cylindrical portion facilitates placement of the end of the elastic cord 125 in the notch 120, and the top portion with the wider diameter helps hold the end of the elastic cord 125 in the notch 120. The elastic cord can be secured within the hollow cylindrical portion by crimping the cylindrical portion around it, using glue, or other techniques. The elastic cord can also be secured within the hollow cylindrical portion by driving a rivet, screw or similar structure through the wall of the hollow cylindrical portion and into the elastic cord. Persons of ordinary skill in the art can identify other structures that can be used as alternatives to stop collars and rivet-like items. Rather than using a different structure, in some embodiments, the ends 130,135 of the elastic cord 125 can be provided with knots to secure the elastic cord 125 in the notches 120. Knots might also be useful when the side structures are provided with holes. Each end of the elastic cord can comprise a knot, knob, stop collar, rivet-like item or similar structure to hold the ends in the corresponding notches, holes, or other structure in the side structures.

Figure 13:
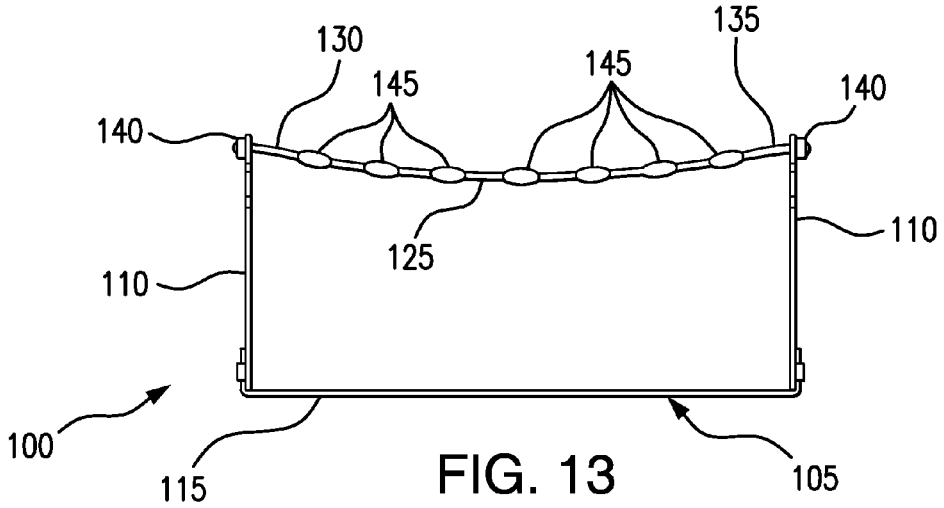
FIG. 13 illustrates a portable leg movement accessory according to one embodiment of the present invention.
Figure 14:
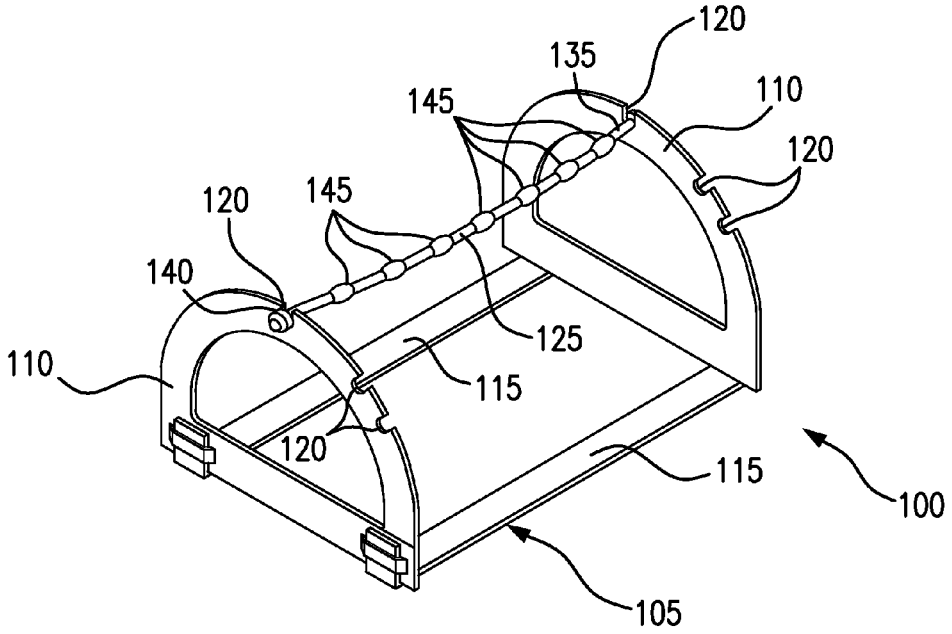
FIG. 14 illustrates a portable leg movement accessory according to one embodiment of the present invention.

In the embodiment shown in FIGS. 13-14, a plurality of beads 145 are threaded on the elastic cord 125. The beads 145 are of a size and shape such that the beads comfort and/or massage the student or user's feet. While not shown in the other Figures, it should be understood that such beads can similarly be provided on the elastic cords in those embodiments.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, the present invention is not limited to the particular embodiments disclosed, but is intended to cover modifications that are within the spirit and scope of the invention.

What is claimed is:

1. An accessory for an item of classroom furniture item having at least two substantially vertical legs, the accessory comprising:

a first support and a second support, wherein the first support is configured to surround at least a portion of a first leg of the at least two substantially vertical legs of the item of classroom furniture and contact a first substantially horizontal surface supporting the first leg, and the second support is configured to surround at least a portion of a second leg of the at least two substantially vertical legs and contact a second substantially horizontal surface supporting the second leg; and an elastic cord comprising two ends, wherein a first end is configured to surround the first leg of the at least two substantially vertical legs and wherein a second end is configured to surround the second leg of the at least two substantially vertical legs, wherein the first and the second supports are configured to contact the first and second ends, respectively, of the elastic cord so as to position the elastic cord at a fixed distance between a point of contact of a respective support with the elastic cord and a point of contact of the respective support with a respective substantially horizontal surface.

2. The accessory of claim 1, wherein each support comprises a hollow tube.

3. The accessory of claim 2, wherein the hollow tube has a circular cross-section with a diameter of at least 1.25 inches.

4. The accessory of claim 3, wherein the hollow tube comprises at least one hinge.

5. The accessory of claim 1, wherein the first or second support has a length of at least six inches.

6. The accessory of claim 5, wherein the first or second support has a length of 12 inches or less.

7. The accessory of claim 1, wherein the first or second support is constructed from plastic or bamboo.

8. The accessory of claim 1, wherein the first end of the elastic cord comprises a first loop configured to slide over the first leg and wherein the second end of the elastic cord comprises a second loop configured to slide over the second leg.

9. A chair comprising the accessory of claim 1, wherein the first support is positioned on a first chair leg, wherein the second support is positioned on a second chair leg, wherein the first end of the elastic cord is coupled to the first leg above the first support, wherein the second end of the elastic cord is coupled to the second leg above the second support, and wherein the first and second supports prevent the elastic cord from sliding down the first and second chair legs, respectively.

10. A desk comprising the accessory of claim 1, wherein the first support is positioned on a first desk leg, wherein the second support is positioned on a second desk leg, wherein the first end of the elastic cord is coupled to the first leg above the first support, wherein the second end of the elastic cord is coupled to the second leg above the second support, and wherein the first and second supports prevent the elastic cord from sliding down the first and second desk legs, respectively.

11. An accessory for an item of classroom furniture having at least two substantially vertical legs, the accessory comprising:

a first hollow tube and a second hollow tube, wherein the first hollow tube and the second hollow tube each have a length of at least six inches, wherein the first hollow tube is configured to surround at least a portion of a first leg of the at least two substantially vertical legs of the item of classroom furniture and contact a first substantially horizontal surface supporting the first leg, and the second hollow tube is configured to surround at least a portion of a second leg of the at least two substantially vertical legs and contact a second substantially horizontal surface; and an elastic cord comprising two ends, wherein a first end is configured to surround the first leg of the at least two substantially vertical legs and wherein a second end is configured to surround the second leg of the at least two substantially vertical legs wherein the first and the second hollow tubes are configured to contact the first and second ends, respectively, of the elastic cord so as to position the elastic cord at a fixed distance between a point of contact of a respective hollow tube with the elastic cord and a point of contact of the respective hollow tube with a respective substantially horizontal surface.

12. The accessory of claim 11, wherein the first or second hollow tube has a circular cross-section with a diameter of at least 1.25 inches.

13. The accessory of claim 11, wherein the first or second hollow tube comprises at least one hinge.

14. The accessory of claim 11, wherein the first or second hollow tube has a length of 12 inches or less.

15. The accessory of claim 11, wherein the first or second hollow tube is constructed from plastic or bamboo.

16. The accessory of claim 11, wherein the first end of the elastic cord comprises a first loop configured to slide over the first leg and wherein the second end of the elastic cord comprises a second loop configured to slide over the second leg.

17. A chair comprising the accessory of claim 11, wherein the first hollow tube is positioned on a first chair leg, wherein the second hollow tube is positioned on a second chair leg, wherein the first end of the elastic cord is coupled to the first leg above the first hollow tube, wherein the second end of the elastic cord is coupled to the second leg above the second hollow tube, and wherein the first and second hollow tubes prevent the elastic cord from sliding down the first and second chair legs, respectively.

18. A desk comprising the accessory of claim 11, wherein the first hollow tube is positioned on a first desk leg, wherein the second hollow tube is positioned on a second desk leg, wherein the first end of the cord is coupled to the first leg above the first hollow tube, wherein the second end of the cord is coupled to the second leg above the second hollow tube, and wherein the first and second hollow tubes prevent the elastic cord from sliding down the first and second desk legs, respectively.

19. An accessory for an item of classroom furniture having at least two substantially vertical legs, the accessory comprising:

a first circular hollow tube and a second circular hollow tube, wherein each tube has a length of at least six inches and a diameter of at least 1.25 inches, and wherein the first tube is configured to surround at least a portion of a first leg of the at least two substantially vertical legs and contact a substantially horizontal surface supporting the first leg, and the second tube is configured to surround at least a portion of a second leg of the at least two substantially vertical legs and contact the substantially horizontal surface; and an elastic cord comprising two ends, wherein a first end comprises a first loop configured to slide over the first leg of the at least two substantially vertical legs and wherein a second end comprises a second loop configured to slide over the second leg of the at least two substantially vertical legs, wherein the first and the second tubes are configured to contact the first and second ends, respectively, of the elastic cord so as to position the elastic cord at a fixed distance between a point of contact of a respective tube with the elastic cord and a point of contact of the respective tube with a respective horizontal surface.

* * * * *